US010455994B2

(12) United States Patent
Lui et al.

(10) Patent No.: US 10,455,994 B2
(45) Date of Patent: Oct. 29, 2019

(54) FOLDABLE AND PORTABLE TOILET DEVICE

(71) Applicant: RIVER LIMITED, Hong Kong (CN)

(72) Inventors: Kam Ming Lui, Hong Kong (CN); Wing Kin Hui, Hong Kong (CN)

(73) Assignee: RIVER LIMITED, Hong Kong (CN)

( * ) Notice: Subject to any disclaimer, the term of this patent is extended or adjusted under 35 U.S.C. 154(b) by 22 days.

(21) Appl. No.: 15/909,149

(22) Filed: Mar. 1, 2018

(65) Prior Publication Data

US 2018/0310784 A1 Nov. 1, 2018

(30) Foreign Application Priority Data

Apr. 28, 2017 (CN) ..... 2017 1 029381

(51) Int. Cl.

| | |
|---|---|
| ***A47K 13/00*** | (2006.01) |
| ***A47K 13/02*** | (2006.01) |
| ***A47K 13/12*** | (2006.01) |
| ***A47K 13/26*** | (2006.01) |
| ***A47K 13/14*** | (2006.01) |

(52) U.S. Cl.

CPC ..... *A47K 13/005* (2013.01); *A47K 13/02* (2013.01); *A47K 13/12* (2013.01); *A47K 13/14* (2013.01); *A47K 13/26* (2013.01)

(58) Field of Classification Search

CPC ..... A47K 13/005; A47K 13/02; A47K 13/12

USPC ..... 4/237, 245.1

See application file for complete search history.

(56) References Cited

U.S. PATENT DOCUMENTS

| | | | | |
|---|---|---|---|---|
| 5,852,832 | A * | 12/1998 | Voigt | A47K 11/06 4/237 |
| 6,175,968 | B1 * | 1/2001 | Schneider | A47K 13/005 4/239 |
| 2016/0242606 | A1 * | 8/2016 | Jackson | A47K 13/005 |

* cited by examiner

*Primary Examiner* — Christine J Skubinna

(74) *Attorney, Agent, or Firm* — Weiss & Moy, P.C.; Jeffrey D. Moy

(57) ABSTRACT

The present invention is adapted to the technical field of toilet, and provides a foldable portable toilet device, comprising: a seat plate is a plurality of folding parts folded left and right and/or front and back, a folding mechanism provided between the adjacent folding parts; and a groove provided at a bottom of the seat plate and matched with an outer shape of the seat plate of the toilet; a handle provided on a side of the seat plate and provided with a first button through which the folding mechanism is controlled to retract; a plurality of stabilizing means provided within the groove of the seat plate; the stabilizing means locks the portable toilet device onto the seat plate of the toilet. In view of this, the foldable portable toilet device provided by the present invention is portable as well as safe and reliable in use.

16 Claims, 7 Drawing Sheets

FOLDABLE AND PORTABLE TOILET DEVICE

TECHNICAL FIELD

The present invention relates to the technical field of toilet, and in particularly, relates to a foldable portable toilet device.

BACKGROUND ART

In current society, people have a higher demand for personal sanitation and care, and it is inevitable to use public health equipment in the daily life. No matter going to work, school, shopping, taking outdoor activities, commuting, etc., or even travelling aboard, they are often used. Although a part of public toilets provide disposable paper toilet mats to avoid users from directly contacting the toilet seat, or disinfectant to allow users to use after cleaning the toilet seat themselves, this cannot satisfy demands of people who have a high demand for personal sanitation, and cannot ensure preventing infection of bacteria.

However, in fact, hot all public toilets provide the above facilities. Even if available, not everyone can use them comfortably, and people often fears of infecting virus by using or contacting public equipment. Prior art includes usage of disposable papers or chemical disinfection products. This is contrary to pursuing environmental protection now and reduction of waste. Public equipment are available for everyone, and their cleaning and disinfection frequencies are low. And nowadays, bacteria spreads and virus rages, such as, hand-foot-and-mouth disease, and even after cleaning/disinfection, not everyone, especially the children and the old who have poor immunity, can use comfortably and prevent virus from raging by one hundred percent.

The foldable and portable sanitary seat plate in the prior inventions only simply considers the problem of folding method and receiving, but it is still inconvenient in use. Moreover, it does not carefully consider the problem of contamination after use and disinfection and sanitation of treating the sanitary seat plate in repeated use. In addition, it is also not easy to be acceptable in appearance, and poor portability and appearance are also important factors.

In conclusion, the existing portable toilet device obviously has inconvenience and defects in practical use, so it is necessary to make improvement.

SUMMARY

With respect to the above defects, an object of the present invention is to provide a foldable portable toilet device such that the device is portable as well as safe and reliable in use.

In order to achieve the above object, the present invention provides a foldable portable toilet device, comprising: a seat plate including a plurality of folding parts folded left and right and/or front and back, a folding mechanism provided between the adjacent folding parts; and a groove provided at a bottom of the seat plate and matched with an outer shape of the seat plate of the toilet; a handle provided on a side of the seat plate and provided with a first button through which the folding mechanism is controlled to retract; and a plurality of stabilizing means provided within the groove of the seat plate; the stabilizing means locks the portable toilet device onto the seat plate of the toilet.

According to the portable toilet device, the folding mechanism includes: a spring hinge installed at a connection between the adjacent two folding parts; a positioning groove provided at a bottom between the two adjacent folding parts; and a positioning bolt provided at the bottom between the two adjacent folding parts and having an outer diameter smaller than an inner diameter of the positioning groove, one end of the positioning bolt connected with a spring connected to the first button; when the two adjacent folding parts are unfolded, the positioning bolt inserted into the positioning groove, and the spring hinge opening; when the first button is pressed, the spring being resilient to drive the positioning bolt to retract from the positioning groove, and the spring hinge closing.

According to the portable toilet device, the handle is provided at a side position of a longitudinal axis of the portable toilet device.

According to the portable toilet device, the stabilizing means includes: at least one pair of slots provided in parallel within the groove; and at least one pair of fixing columns matched with the slots, and one end of the fixing column connected with one end of the slot through an axis of rotation; when the fixing column opens around the axis of rotation, the fixing column is locked onto the seat plate of the toilet.

According to the portable toilet device, the slot has a size larger than that of the fixing column.

According to the portable toilet device, the stabilizing means includes four or more, and the stabilizing means are symmetrically provided on left and right sides, and/or front and back sides of the portable toilet device, respectively.

According to the portable toilet device, the fixing columns is made of stainless steel or other solid alloys.

According to the portable toilet device, the seat plate is in a smooth strip; and the seat plate includes two folding parts folded front and back between which the folding mechanism is provided.

According to the portable toilet device, the seat plate is in a smooth strip; and the seat plate includes four folding parts folded front and back as well as left and right, wherein the folding mechanism is provided between the two folding parts folded front and back, and the folding mechanism is provided between back ends of the portable toilet device where the two folding parts folded left and right are.

According to the portable toilet device, the seat plate is oval when the portable toilet device is unfolded.

According to the portable toilet device, the seat plate includes two folding parts folded left and right, each of the folding parts is divided into a front end and a back end which is tubular, and an outer shape of the front end is matched with a tubular portion of the back end.

According to the portable toilet device, the front end is received in the back end when the portable toilet device is folded; the from end extends from the back end when the portable toilet device is unfolded.

According to the portable toilet device, the seat plate is in a circular arc, or a L shape after being folded.

According to the portable toilet device, the portable toilet device further comprises: an outer box matched with the folded seat plate; the folded seat plate is placed in the outer box.

According to the portable toilet device, the portable toilet device is made of plastic.

According to the portable toilet device, the portable toilet device is made of memory plastic; and a surface of the portable toilet device is coated with water proof coating such as material produced by nanotechnology.

According to the portable toilet device, an opening is provided at a end of the seat plate.

The present invention configures that the foldable portable toilet device comprises a seat plate including a plurality of folding parts folded left and right and/or front and back, a folding mechanism provided between the adjacent folding parts; and a groove provided at a bottom of the seat plate and matched with an outer shape of the seat plate of the toilet; a handle provided on a side of the seat plate and provided with a first button through which the folding mechanism is controlled to retract; and a plurality of stabilizing means provided within the groove of the seat plate; the stabilizing means locks the portable toilet device onto the seat plate of the toilet. Accordingly, the foldable portable toilet device can be folded and carried conveniently, and during use, since it uses the stabilizing means, it is more safe in use. In addition, it also caters to people's demand for increasing sanitation awareness, and prevents bacterial infection. Moreover, as people almost need to use public toilets every day, the foldable portable toilet device is portable and sanitary as well as with attractive appearance, and the usage rate will be greatly increased. Finally, it safeguards personal sanitation and service environment, and also can increase protection against virus infection at the same time, such that transmission of bacteria and virus is controlled, and it helps to maintain public health.

DETAILED DESCRIPTION OF THE ILLUSTRATED EMBODIMENTS

In order to clarify the objective, technical solution and advantages of the present invention, further explanations to the present invention are set forth with the figures and examples below. It should be understood that the detailed examples described here are only to explain the present invention, instead of defining the present invention.

Figure 1A:
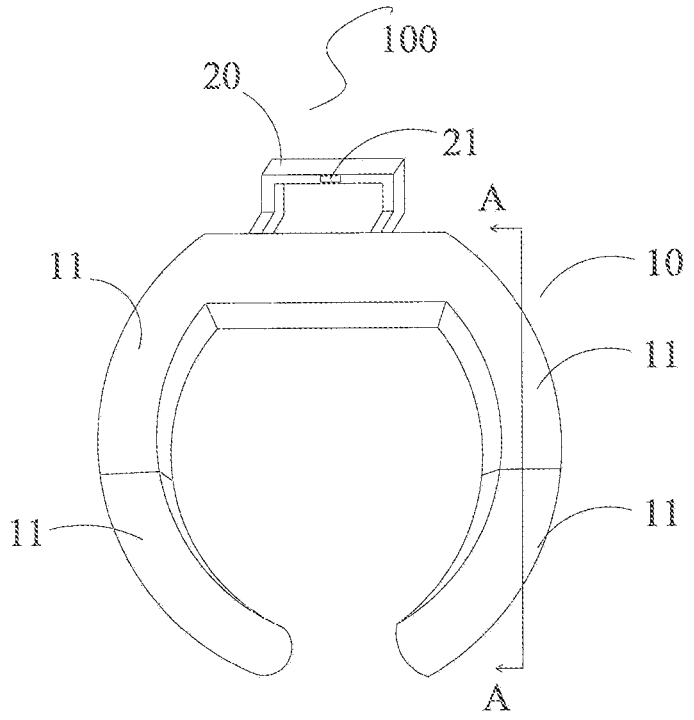
FIG. 1A is a perspective top view of the foldable portable toilet device provided in the example of the present invention.
Figure 1B:
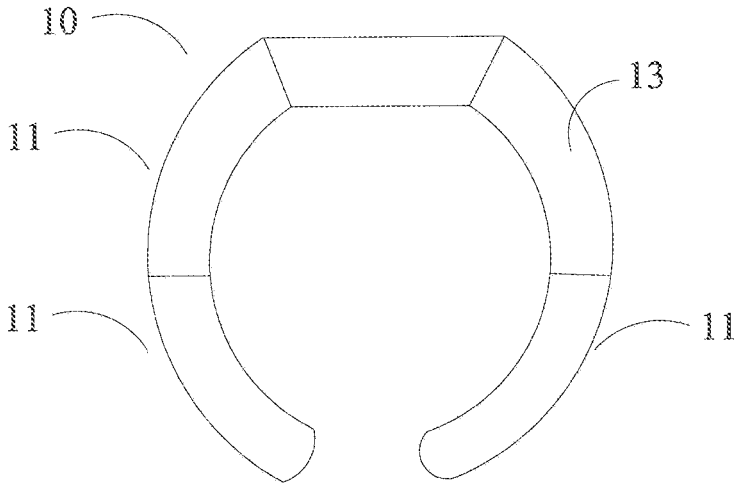
FIG. 1B is a structure bottom view of the foldable portable toilet device provided in the example of the present invention.

Referring to FIGS. 1A-1B, in the first example of the present invention, it provides a foldable portable toilet device 100, comprising: a seat plate 10 including a plurality of folding parts 11 folded left and right and/or front and back, a folding mechanism 12 provided between the adjacent folding parts 11; and a groove 13 provided at a bottom of the seat plate 10 and matched with an outer shape of the seat plate of the toilet 200; a handle 20 provided on a side of the seat plate 10 and provided with a first button 21 through which the folding mechanism 12 is controlled to retract; and a plurality of stabilizing means 14 provided within the groove 13 of the seat plate 10; the stabilizing means 14 locks the portable toilet device 100 onto the seat plate of the toilet 200.

In this example, the foldable portable toilet device 100 comprises the seat plate 10 and the handle 20; the groove 13 is provided at the bottom of the seat plate 10, and when it is used, the groove 13 matched and connected with the seat plate of the toilet 200. The handle 20 facilitates the users to hold the foldable portable toilet device 100. The handle 20 may be provided on a side of the portable toilet device 100, but preferably, the handle 20 is provided at a side position of a longitudinal axis of the portable toilet device 100. The seat plate 10 includes a plurality of folding parts 11, and the folding mechanism 12 is provided between the adjacent folding parts 11, so the seat plate 10 is foldable, for example, it can be folded left and right and/or front and back, and the folding mechanism 12 can be controlled to retract through the first button 21 on the handle 20. Accordingly, the portable toilet device 100 can be folded and carried conveniently, and it is also convenient for the users to use. In addition, since a plurality of stabilizing means 14 are provided within the groove 13 of the seat plate 10, the stabilizing means 14 locks the portable toilet device 100 onto the seat plate of the toilet 200. The bottom or the groove 13 of the portable toilet device 100 is installed with a plurality of fixing columns 142. When the portable toilet device 100 is unfolded, it is placed on the original toilet seat (i.e., the seat plate of the toilet 200) for use, and the fixing columns 142 helps to fix position of the portable toilet device 100, such that it does not move, and ensures safety of the users.

Figure 2A:
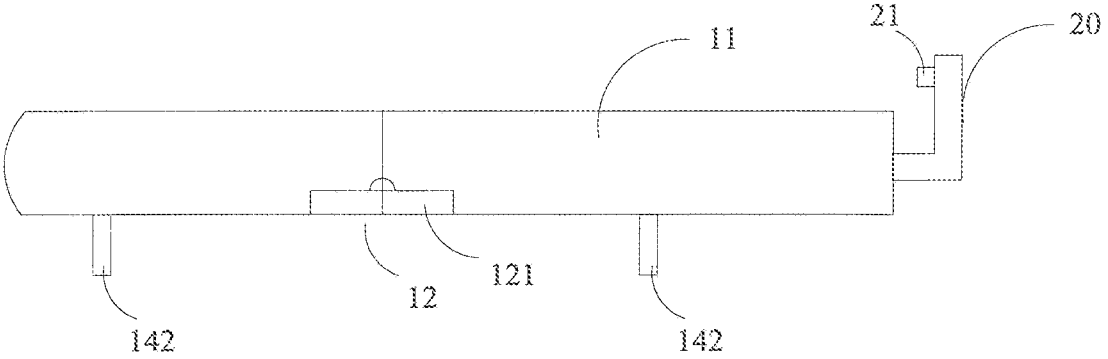
FIG. 2A is a side view of the foldable portable toilet device in the unfolding state provided in the example of the present invention.
Figure 2B:
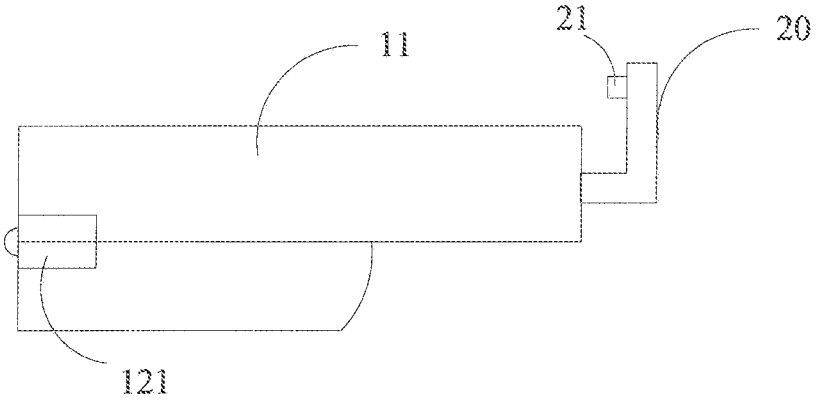
FIG. 2B is a side view of the foldable portable toilet device in the folding state provided in the example of the present invention.
Figure 2C:
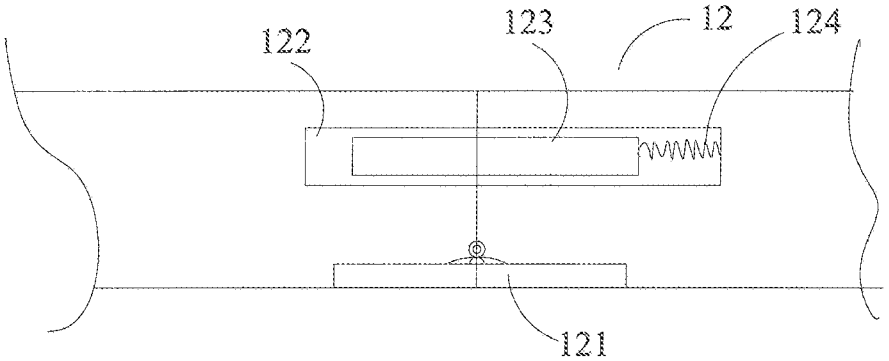
FIG. 2C is a section view along A-A direction of FIG. 1A.

Referring to FIGS. 2A-2C, in the second example of the present invention, the folding mechanism 12 includes: a spring hinge 121 installed at a connection between the adjacent two folding parts 11; a positioning groove 122 provided at a bottom between the two adjacent folding parts 11; and a positioning bolt 123 provided at the bottom between the two adjacent folding parts 11 and having an outer diameter smaller than an inner diameter of the positioning groove 122, one end of the positioning bolt 123 connected with a spring 124 connected to the first button 21; when the two adjacent folding parts 11 are unfolded, the positioning bolt 123 inserted into the positioning groove 122, and the spring hinge 121 opening; when the first button 21 is pressed, the spring 124 being resilient to drive the positioning bolt 123 to retract from the positioning groove 122, and the spring hinge 121 closing.

In this example, the folding mechanism 12 is provided with the spring-loaded spring hinge 121 for connecting the front and back of the foldable portable toilet device 100, i.e., the spring hinge 121 is installed at a connection between the adjacent two folding parts 11; when the foldable portable toilet device 100 is unfolded for use, a hinge in the spring hinge 121 is applied with a load by the spring, and in order to prevent the spring hinge 121 from folding automatically due to the spring-loaded hinge, the position where the folding mechanism 12 is provided is in an unfolding state. To be specific, the foldable portable toilet device 100 comprises the positioning groove 122 and the positioning bolt 123 which are both provided at the bottom between the two adjacent folding parts 11; and the positioning bolt 123 can be pushed forwardly or backwardly. When the seat plate 10 is unfolded, the positioning bolt 123 will be pushed forwardly to the positioning groove 122 due to a gravitation force caused by the portable toilet device 100 leaning forward, and the spring load of the folding mechanism 12 will not cause folding action, i.e., the spring load of the spring hinge 121 will not cause folding action. The function is to use when the spring hinge 121 is in the unfolding state. Preferably, the positioning bolt 123 has an outer diameter smaller than an inner diameter of the positioning groove 122, such that the positioning bolt 123 can be inserted into the positioning groove 122. Moreover, one end of the positioning bolt 123 is connected with a spring connected to the first button 21; when the two adjacent folding parts 11 are unfolded, the positioning bolt 123 is inserted into the positioning groove 122, and the spring hinge 121 opens; when the first button 21 is pressed, the spring is resilient to drive the positioning bolt 123 to retract from the positioning groove 122, and the spring hinge 121 closes, such that retraction of the seat plate 10 is achieved. The positioning bolt 123 is controlled by the first button 21 on the handle 20 to retract into a rear half portion of the device while allowing the spring-loaded hinge of the spring hinge 121 to perform the folding action, thereby achieving retraction of the seat plate 10.

Figure 3:
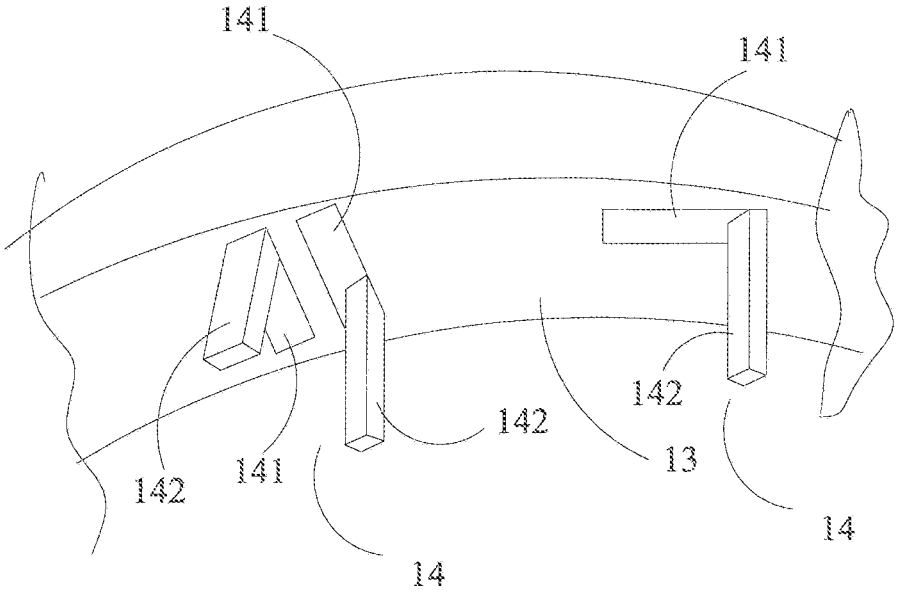
FIG. 3 is a perspective bottom view of the stabilizing means of the portion of the foldable portable toilet device provided in the example of the present invention.

Referring to FIG. 3, in the third example of the present invention, the stabilizing means 14 includes: at least one pair of slots 141 provided in parallel within the groove 13; and at least one pair of fixing columns 142 matched with the slots 141, and one end of the fixing column 142 connected with one end of the slot 141 through an axis of rotation (not shown).

In this example, when the fixing column 142 opens around the axis of rotation, the fixing column 142 is locked onto the seat plate of the toilet 200. The slot has a size larger than a size of the fixing column 142, such that the fixing column 142 can utilize the principle of gravity to be in a upright position when the portable toilet device 100 is in used, i.e., the portable toilet device 100 is unfolded horizontal and place on top of a toilet 200; or the portable toilet device 100 is in upside down position, the fixing column 142 falls back to the slot 141 due to gravitation force. Preferably, the stabilizing means 14 includes four or more, and the stabilizing means 14 are symmetrically provided on left and right sides, and/or front and back sides of the portable toilet device 100, respectively. For example, the right pair of fixing columns 142 becomes a combination having four to six groups, and is distributed and stored at the bottom of the plurality of folding parts 11 folded left and right and/or front and back of the seat plate 10 of the portable toilet device 100, or within the groove 13 thereof. In addition, the fixing column 142 is selected from a material of stainless steel or other solid alloys. The fixing column 142 of the portable toilet device 100 is made of stainless steel or other solid alloys, which is not only durable, but also having enough bearing and supporting force while being convenient for cleaning.

Figure 4:
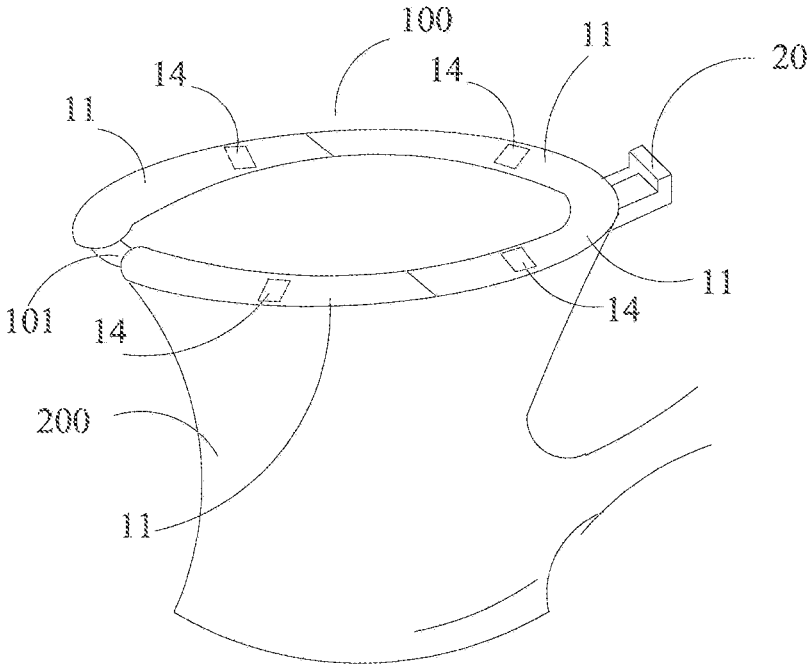
FIG. 4 is a perspective view of the foldable portable toilet device installed on a toilet provided in the example of the present invention when in use.
Figure 5:
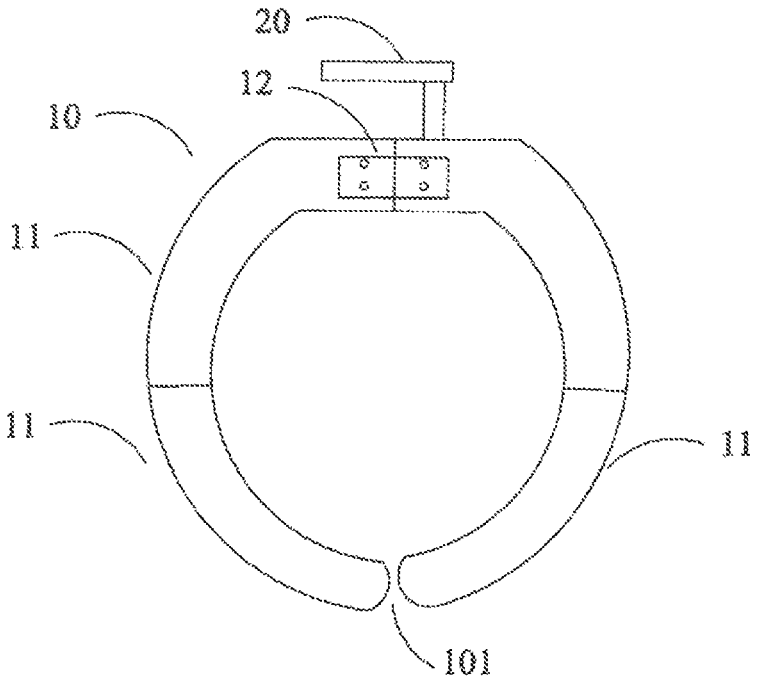
FIG. 5 is a top view of the foldable portable toilet device provided in the example of the present invention when it is unfolded.
Figure 6:
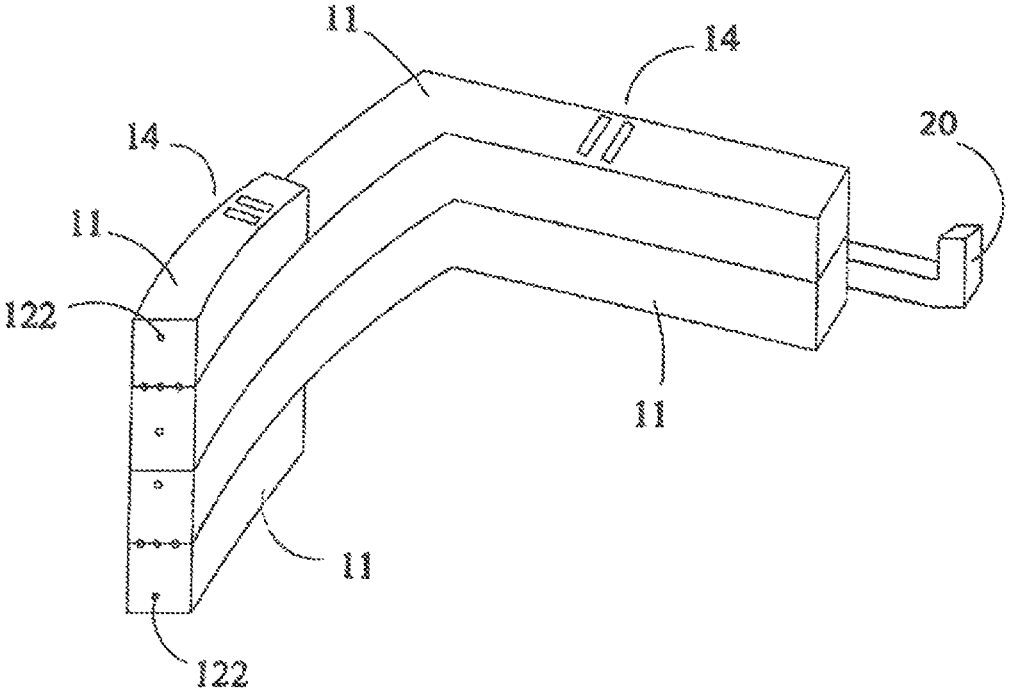
FIG. 6 is a perspective view of the foldable portable toilet device provided in the example of the present invention when it is fully folded.

Referring to FIGS. 4-6, in the fourth example of the present invention, the seat plate 10 is in a smooth strip; and the seat plate 10 includes two folding parts 11 folded front and back between which the folding mechanism 12 is provided.

Alternatively, the seat plate 10 is in a smooth strip; and the seat plate 10 includes four folding parts 11 folded front and back as well as left and right, wherein the folding mechanism 12 is provided between the two folding parts 11 folded front and back, and the folding mechanism 12 is provided between back ends of the portable toilet device 100 where the two folding parts 11 folded left and right are.

In this example, the seat plate 10 is oval when the portable toilet device 100 is unfolded, wherein a spring-loaded means, i.e., the spring hinge 121, is provided on left and right sides of the portable toilet device 100, and the handle 20 is provided at a center axis position of the portable toilet device 100. When it is unfolded, the shape is substantially oval. An opening 101 is provided in the front of the seat plate 10, and there is no connection.

Referring to FIGS. 5 and 6, in the fifth example of the present invention, the portable toilet device 100 may be advanced from one-fold to a two-fold method. Except that the portable toilet device 100 can be folded front and back, it also can be folded left and right. The spring hinge 121 is installed in a center panel at the back of the portable toilet device 100, and uses the groove of the portable toilet device 100, such that the spring hinge 121 will not protrude from the panel. The spring hinge 121 is provided with a connection at the front center position of the portable toilet device 100, and the handle provided at the back of the portable toilet device 100 is only connected with one side. As shown in FIG. 6, it can be connected with the right of the portable toilet device 100, and in another embodiment of the present invention, the handle 20 also can be connected with the left side of the portable toilet device 100.

Referring to FIG. 5, when the portable toilet device 100 is unfolded, the shape is also substantially oval. An opening 101 can be provided in the front of the seat plate 10 with a distance of about 4 cm. The front does not have the opening 101 in one of the embodiment, but also does not have the connection. As shown in FIG. 6, a predetermined order of folding is preferred, with front and back folded inwardly at first, as shown in the side view of FIG. 2B, and then folded left and right, so the bottom of the portable toilet device 100 will be facing outward. The handle 20 as shown in FIG. 6 is connected with the right in the state after the two-fold storing, and the shape is substantially a L letter. In addition, the portable toilet device 100 provided in this example also may be provided with the stabilizing means 14. To be specific, the fixing columns 142 of the stabilizing means 14 are provided at the bottom of the device. One or more pairs of grooves 13 are provided for storing the fixing columns 142, one end of the fixing column 142 can be installed within the groove 13 around the axis of rotation, and each groove 13 can store one or more fixing columns 142. The bottom is shown in FIG. 3. The groove 13 can be substantially a right angle to the device as shown in the left position of FIG. 3, and the groove 13 also can be substantially balanced as shown in the right position of FIG. 3. Only one of the grooves 13 and the fixing columns 142 is shown in FIG. 3. The fixing column 142 is installed at the bottom of the portable toilet device 100. In one of the embodiments, a space within the groove 13 is larger than the fixing column 142, and the gravity can be used to allow the fixing column to slide downwardly to retract the fixing column 142, such that the device can be upside down, and the fixing column 142 is received within the groove 13 due to the gravity. Then the first button 21 folds the device using the spring-loaded hinge.

Referring to FIGS. 7A-7E, in the sixth example of the present invention, the seat plate 10 is in a smooth strip; the seat plate 10 includes two folding parts 11 folded left and right, each of the folding parts 11 is divided into a front end 111 and a back end 112 which is tubular, and an outer shape of the front end 111 is matched with a tubular portion of the back end 112. The front end 111 is received in the back end 112 when the portable toilet device 100 is folded; the front end 111 extends from the back end 112 when the portable toilet device 100 is unfolded.

Figure 7A:
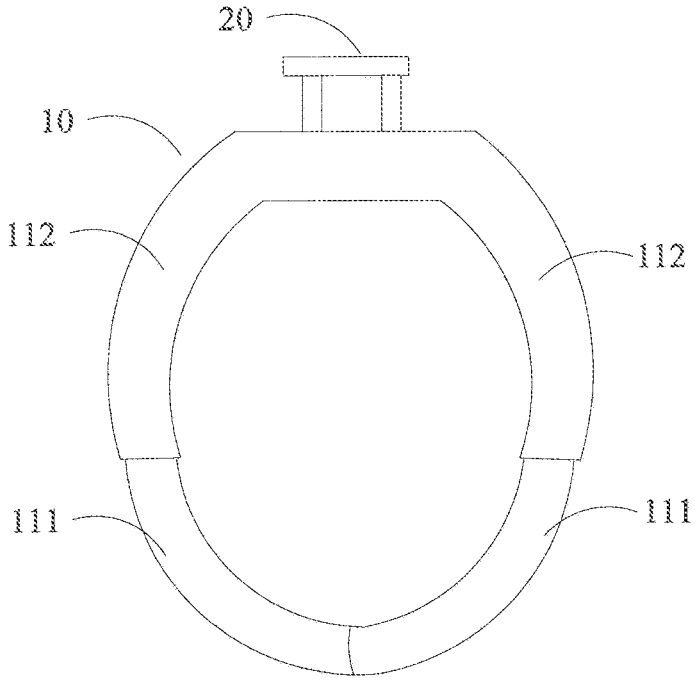
FIG. 7A is a top view of the foldable portable toilet device provided in the example of the present invention when it is fully extended.
Figure 7B:
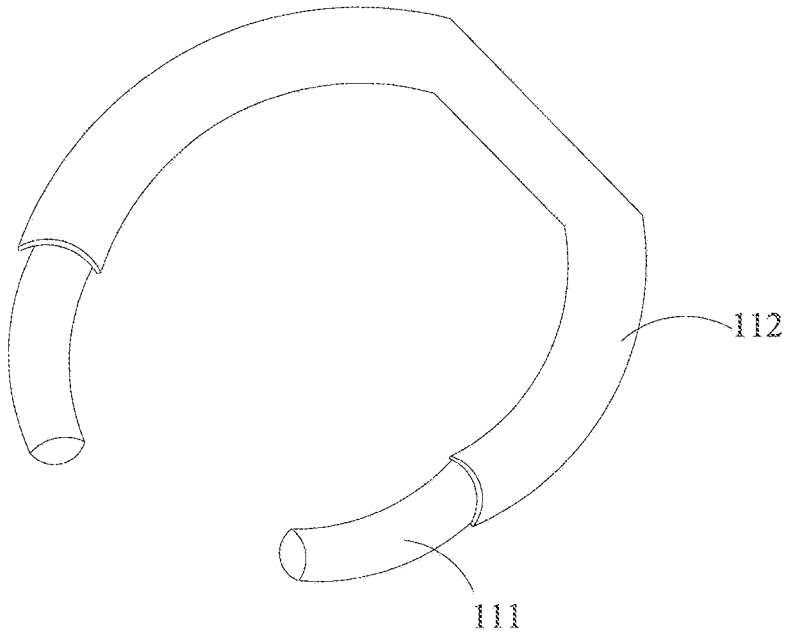
FIG. 7B is a perspective view of the seat plate of the foldable portable toilet device provided in the example of the present invention when it is retracked.

In this example, the handle 20 is provided in the center position at the back. When it is unfolded, the shape is substantially oval, and the front center is not provided with the opening 101, but also does not have connection. The front arms on left and right sides are portions extending from the left and right back till the front center position. Referring to FIG. 7A, it is a top view of the portable toilet device 100. To be specific, the back end 112 at the back of the banana-shaped portable toilet device 100 is a hollow tube, and the front end 111 in the front is tubular. The front end 111 has an outer size matched with the middle passage of the back end 112, such that it can slide forwardly or backwardly in the back passage. Referring to the stereogram of FIG. 7B, the front end 111 sliding forwardly can extend to the front center position to the connection as shown in FIG. 7A, or approximate to the connection, for example, the front arms on the left and right have a distance of 4 cm, and connecting or having different distance can be suitable for the needs of different embodiments. When the portable toilet device 100 leans forward, a force is produced to extend the front end 111 as the front arm forwardly to the front center position, so as to approximate to connection or not connection for use. On the other side, after using, the portable toilet device 100 leans backwardly or upwardly to produce the force to retract the front end 111 into the back end 112 at the back. The fixing column 142 is installed at the bottom of the portable toilet device 100, and also uses the principle of gravity as the above embodiment, i.e., the portable toilet device 100 is unfolded downwardly, or the portable toilet device 100 is upside down, sliding or retracting downwardly.

Figure 7C:
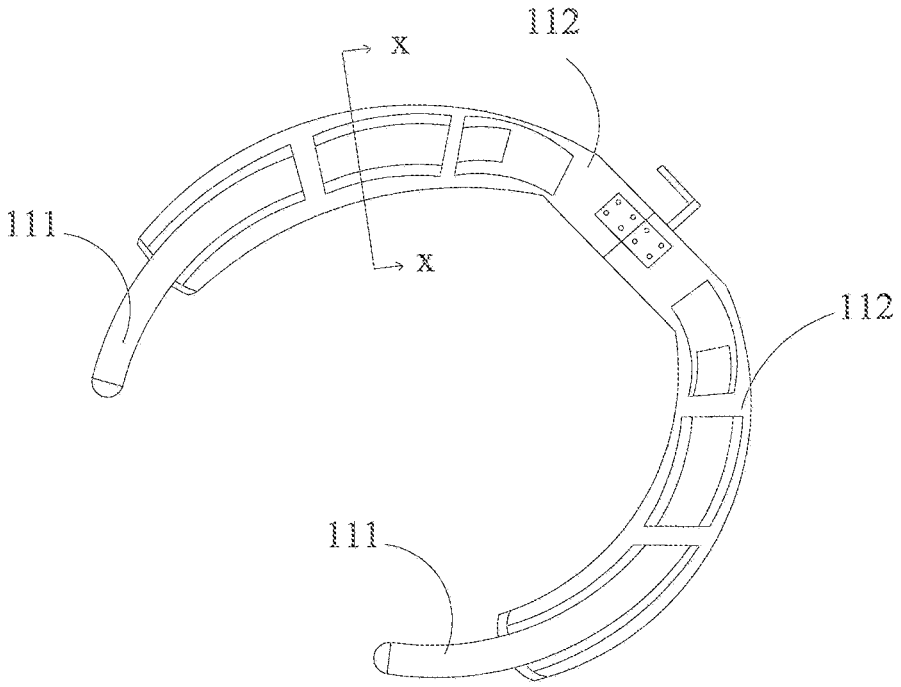
FIG. 7C is a bottom view of the foldable portable toilet device provided in the example of the present invention.

Referring to FIGS. 7A-7E, in the seventh example of the present invention, the folding mechanism 12 for unfolding and folding the portable toilet device 100 is installed at the position of the center axis of the back of the portable toilet device 100. As shown in FIG. 7C, the bottom of the portable toilet device 100 is provided with the groove 13 installed with the hinge for connecting the left and right. The handle provided at the back of the portable toilet device 100 is only connected with one side. As shown in the bottom stereogram of FIG. 7C, it can be connected with the left of the portable toilet device 100, and in another embodiment, it also can be connected with the right of the portable toilet device 100.

Figure 7D:
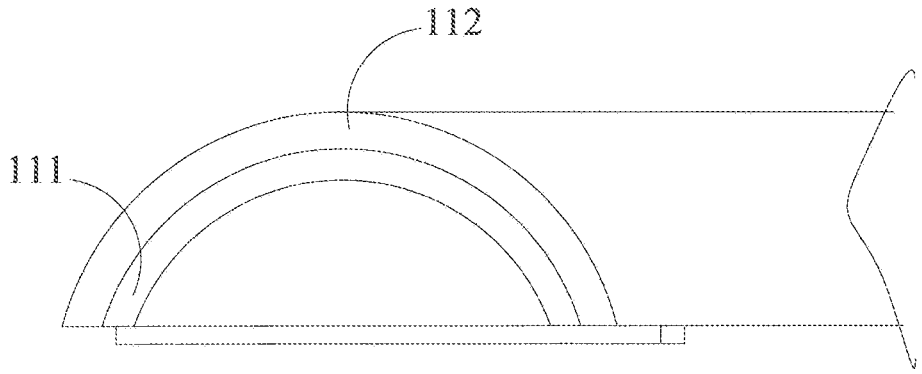
FIG. 7D is a section view along X-X direction of FIG. 7C.

In this example, the back passage (i.e., the back end 112) is half cylindrical and hollow. In one of the embodiments, the bottom of the back passage is open, and a beam is provided only at a part of positions to connect the two sides, as seen in the bottom stereogram of FIG. 7C. FIG. 7D is a section view of the portion from position X to position X in FIG. 7C, and it can be clearly seen that the front arm (the front end 111) is matched with the back passage, while the bottom is provided with the beam. The bottom of the tube is further provided with the fixing column 142 of the portable toilet device 100, and the fixing column 142 can be folded into the bottom. The front arm is also installed with foldable fixing column 142, and the fixing column 142 is not shown in FIG. 7C. In addition, the front arm can slide forwardly or backwardly with the force produced due to the portable toilet device 100 leaning forward, or backward (i.e., upwardly). In FIG. 7C, it shows the state that the front arm extends about half out of the back passage.

Figure 7E:
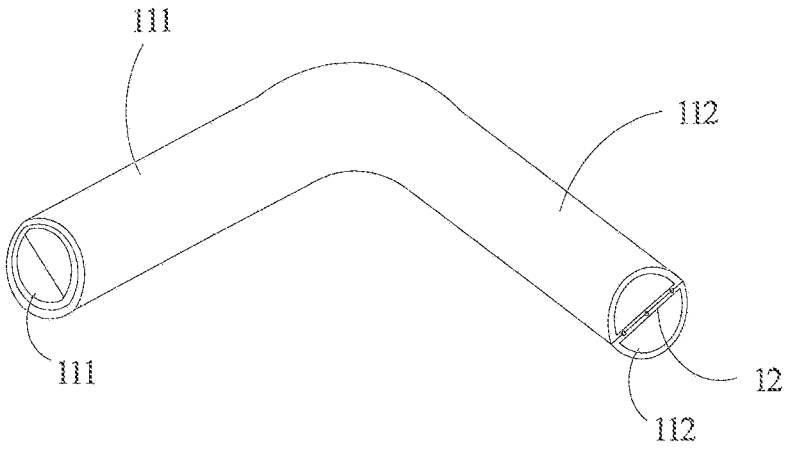
FIG. 7E is a perspective view of the seat plate of the foldable portable toilet device provided in the example of the present invention when it is folded.

In one embodiment of the present invention, the folding order of the portable toilet device 100 is to completely fold the front arms on the left and right backwardly into the back portion at first, and then press the first button on the handle to allow the spring to apply the load to perform the folding action. Subsequently, it is folded left and right, and the bottom of the portable toilet device 100 will be inwardly. As shown in FIG. 7E, it is a stereogram of the portable toilet device 100 after being folded. In addition, the seat plate 10 is in a circular arc, or a L shape after being folded.

In one preferable example of the present invention, the portable toilet device 100 further comprises: an outer box matched with the folded seat plate 10; the folded seat plate 10 is placed in the outer box. The portable toilet device 100 is made of plastic; the portable toilet device 100 is made of memory plastic; and a surface of the portable toilet device 100 is coated with water proof coating such as material produced by nanotechnology.

In this example, since the portable toilet device 100 is made of the material with a light weight and enough support force, such as, plastic, memory plastic, it can be used for several times, and no matter it is folded and unfolded for several times, the shape can be remained unchanged, and durability is improved. When the portable toilet device 100 is unfolded (when being used), the shape is substantially oval. The folding method has different solutions, including folded front and back (one-fold), or folded left and right (two-fold) into smaller size after being folded front and back. Moreover, the portion of the portable toilet device 100 can be a smooth strip or a curved tube/banana shape, but it has suitable outer box for receiving it so as to be convenient for carrying.

The outer surface of the portable toilet device 100 is specially treated (for example, water proof treatment by nanotechnology). After it contacts other objects, it can prevent foreign material from being stained, and it has the function of wet resistance, antipollution and self-cleaning. Due to the above functions, the portable toilet device 100 can repel liquid/dust, even bacteria. After using, it can be used again at ease without cleaning and disinfection. The portable toilet device 100 can be folded back in time after using, or can be put into the provided box with the same shape to improve health protection and convenient for carrying. The outer box is also specially treated on the outer surface, and it can be used at ease without worrying about the health problem. Both do not have to worry about the health problem. When repeated using the portable toilet device 100 every day, the users only need to simply clean it with water without additional disinfection. It is convenient and efficient, and suitable for the modern life.

In conclusion, the present invention configures that the foldable portable toilet device comprises a seat plate including a plurality of folding parts folded left and right and/or front and back, a folding mechanism provided between the adjacent folding parts; and a groove provided at a bottom of the seat plate and matched with an outer shape of the seat plate of the toilet; a handle provided on a side of the seat plate and provided with a first button through which the folding mechanism is controlled to retract; and a plurality of stabilizing means provided within the groove of the seat plate; the stabilizing means locks the portable toilet device onto the seat plate of the toilet. Accordingly, the foldable portable toilet device can be folded and carried conveniently, and during use, since it uses the stabilizing means, it is more safe in use. In addition, it also caters to people's demand for increasing sanitation awareness, and prevents bacterial infection. Moreover, as people almost need to use public toilets every day, the foldable portable toilet device is portable and sanitary as well as tine in appearance, and the usage rate will be greatly increased. Finally, it safeguards personal sanitation and service environment, and also can increase defense against virus infection at the same time, such that transmission of bacteria and virus is controlled, and it helps to maintain public health.

Of course, the present invention also may have a variety of other examples, and the person skilled in the art can make various corresponding modifications and variations according to the present invention without depart of the spirit and substance of the present invention, but these corresponding modifications and variations shall belong to the scope protected by the appended claims of the present invention.

The invention claimed is:

1. A foldable portable toilet device, characterized in that it comprises:

a seat plate including a plurality of folding parts folded left and right and/or front and back, a folding mechanism provided between the adjacent folding parts; and a groove provided at a bottom of the seat plate and matched with an outer shape of the seat plate of the toilet;

a handle provided on a side of the seat plate and provided with a first button through which the folding mechanism is controlled to retract; and a plurality of stabilizing means provided within the groove of the seat plate; the stabilizing means locks the portable toilet device onto the seat plate of the toilet.

2. The portable toilet device according to claim 1, characterized in that the folding mechanism includes:

a spring hinge installed at a connection between the adjacent two folding parts;

a positioning gross e provided at a bottom between the two adjacent folding parts; and a positioning bolt provided at the bottom between the two adjacent folding parts and having an outer diameter smaller than an inner diameter of the positioning groove, one end of the positioning bolt connected with a spring connected to the first button; when the two adjacent folding parts are unfolded, the positioning bolt inserted into the positioning groove, and the spring hinge opening; when the first button is pressed, the spring being resilient to drive the positioning bolt to retract from the positioning groove, and the spring hinge closing.

3. The portable toilet device according to claim 1, characterized in that the handle is provided at a side position of a longitudinal axis of the portable toilet device.

4. The portable toilet device according to claim 1, characterized in that the stabilizing means includes:

at least one pair of slots provided in parallel within the groove; and at least one pair of fixing columns matched with the slots, and one end of the fixing column connected with one end of the slot through an axis of rotation;

when the fixing column opens around the axis of rotation, the fixing column is locked onto the seat plate of the toilet.

5. The portable toilet device according to claim 4, characterized in that the slot has a size larger than that of the fixing column.

6. The portable toilet device according to claim 1, characterized in that the stabilizing means includes four or more, and the stabilizing means are symmetrically provided on left and right sides, and/or front and back sides of the portable toilet device, respectively.

7. The portable toilet device according to claim 1, characterized in that the seat plate is in a smooth strip; and the seat plate includes two folding parts folded front and back between which the folding mechanism is provided.

8. The portable toilet device according to claim 1, characterized in that the seat plate is in a smooth strip; and the seat plate includes four folding parts folded front and back as well as left and right, wherein the folding mechanism is provided between the two folding parts folded front and back, and the folding mechanism is provided between back ends of the portable toilet device where the two folding parts folded left and right are.

9. The portable toilet device according to claim 7 or 8, characterized in that the seat plate is oval when the portable toilet device is unfolded.

10. The portable toilet device according to claim 1, characterized in that the seat plate includes two folding parts folded left and right, each of the folding parts is divided into a front end and a back end which is tubular, and an outer shape of the front end is matched with a tubular portion of the back end.

11. The portable toilet device according to claim 10, characterized in that the front end is received in the back end when the portable toilet device is folded; the front end extends from the back end when the portable toilet device is unfolded.

12. The portable toilet device according to claim 1, characterized in that the seat plate is in a circular arc, or a L shape after being folded.

13. The portable toilet device according to claim 12, characterized in that the portable toilet device further comprises:

an outer box matched with the folded seat plate; the folded seat plate is placed in the outer box.

14. The portable toilet device according to claim 1, characterized in that the portable toilet device is made of plastic.

15. The portable toilet device according to claim 1, characterized in that the portable toilet device is made of memory plastic; and a surface of the portable toilet device is coated with a nanometer technology ultimate waterproof industrial coating.

16. The portable toilet device according to claim 1, characterized in that an opening is provided at a front end of the seat plate.

* * * * *